United States Patent [19]

Wilson

[11] 4,243,138

[45] Jan. 6, 1981

[54] THREE-PIECE FOLDABLE BASKET CARRIER AND BLANK FOR FORMING THE SAME

[75] Inventor: Jerry F. Wilson, West Monroe, La.

[73] Assignee: Olinkraft, Inc., Denver, Colo.

[21] Appl. No.: 28,760

[22] Filed: Apr. 10, 1979

[51] Int. Cl.[3] ..... B65D 5/48

[52] U.S. Cl. ..... 206/188; 206/193; 229/28 BC; 229/52 BC; 229/15

[58] Field of Search ..... 206/172, 180, 181, 185–189, 206/191, 193, 428; 229/28 BC, 52 BC, 28 R, 15

[56] References Cited

U.S. PATENT DOCUMENTS

| | | | |
|---|---|---|---|
| Re. 24,789 | 3/1960 | Pasjack | 229/28 R |
| 2,687,232 | 8/1954 | Arnèson | 229/52 BC |
| 3,610,511 | 10/1971 | Engdahl, Jr. | 229/28 |
| 3,825,171 | 7/1974 | Dewhurst | 229/28 BC |
| 4,117,925 | 10/1978 | Wood | 229/28 BC |

*Primary Examiner*—Joseph Man-Fu Moy

*Attorney, Agent, or Firm*—Robert M. Krone; Joseph J. Kelly; Norvell E. Von Behren

[57] ABSTRACT

A foldable basket carrier has front and rear panel assemblies hinged about common edges of center panels wherein the center panels form a full two-ply center keel.

7 Claims, 6 Drawing Figures

THREE-PIECE FOLDABLE BASKET CARRIER AND BLANK FOR FORMING THE SAME

TECHNICAL FIELD

The present invention relates to foldable basket carriers formed from paperboard material for carrying a plurality of articles such as eight bottles.

BACKGROUND ART

The prior art, as exemplified in U.S. Pat. No. 2,755,963,No. 3,190,487, No. 3,191,800, No. 3,362,613, No. 3,402,872, No. 3,411,663, No. 3,554,401, No. 3,610,511, No. 3,642,790, No. 3,661,297, No. 3,722,737 and No. 4,117,925, contains a number of paperboard basket-type article carriers, some of which are foldable. Generally the prior art basket carriers have one or more deficiencies such as (1) being subject to tearing and failure when containing a large number of bottles (for example eight bottles), (2) requiring extra assembly and folding steps, (3) not providing sufficient separation between fragile articles, etc.

SUMMARY OF THE INVENTION

The invention is summarized in a foldable basket carrier including front and rear first center panels; front and rear second center panels having inner edge portions overlapping and secured to inner edge portions of the respective first center panels to form front and rear full center members; front and rear left side panels and front and rear right side panels hingedly joined at inner edges thereof to outer edges of the respective front and rear first center panels and front and rear second center panels; front and rear wall panels hingedly connected at the right and left edges thereof to outer edges of the respective front and rear panels of the right and left side panels; front and rear bottom panel means hingedly joined together at inner edges thereof and hingedly joined at outer edges thereof to respective bottom edges of the front and rear wall panels; the front and rear full center members being hingedly connected together at the top edges thereof, being secured back to back, having handle portions formed through upper portions thereof, and extending substantially the full length and height of the carrier to form a strong full two-ply center support; and front and rear partition means secured between the front surface of the center support and the front wall panel and between the rear surface of the center support and the rear wall panel, respectively, for forming a plurality of front and rear article receiving cells.

An object of the invention is to construct a more durable, foldable basket carrier.

Another object of the invention is to create a full protection basket carrier for bottles with a strong handle.

It is also an object of the invention to provide a basket carrier with a relatively more solid construction permitting the carrying of a greater number of articles.

Additional features of the invention which may be included therein are the provision of two partition pieces which are installed in a flat non-folded condition initially and remain in this flat condition while the carrier is collapsed or folded; and the provision of a handle structure having at least six plies of paperboard to form a relatively rigid strong handle.

Other objects, advantages and features of the invention will be apparent from the following description of the preferred embodiment taken in conjunction with the accompanying drawings.

DESCRIPTION OF THE PREFERRED EMBODIMENT

Figure 1:
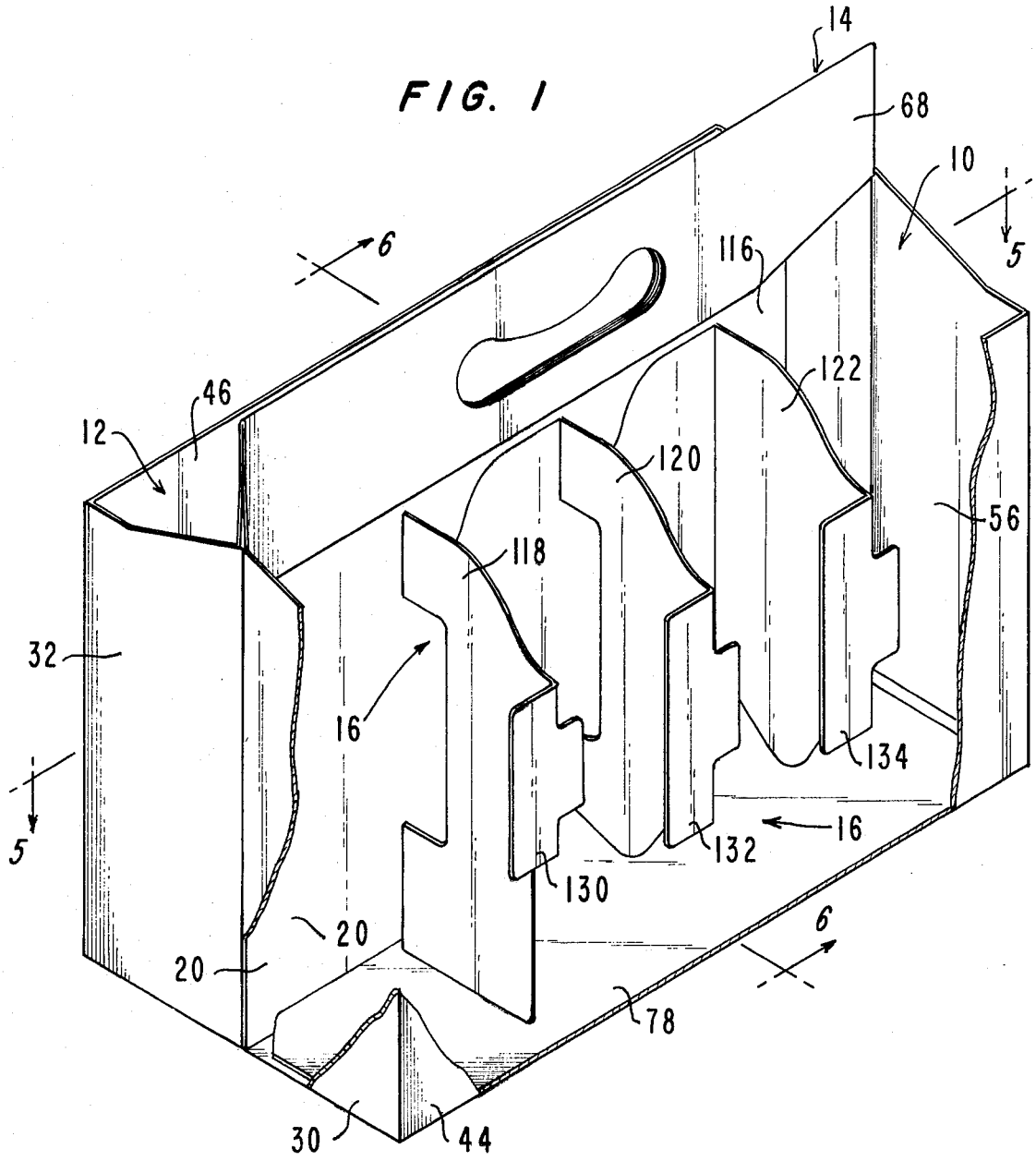
FIG. 1 is a perspective view, with portions broken away, of a foldable basket carrier in accordance with the invention.
Figure 5:
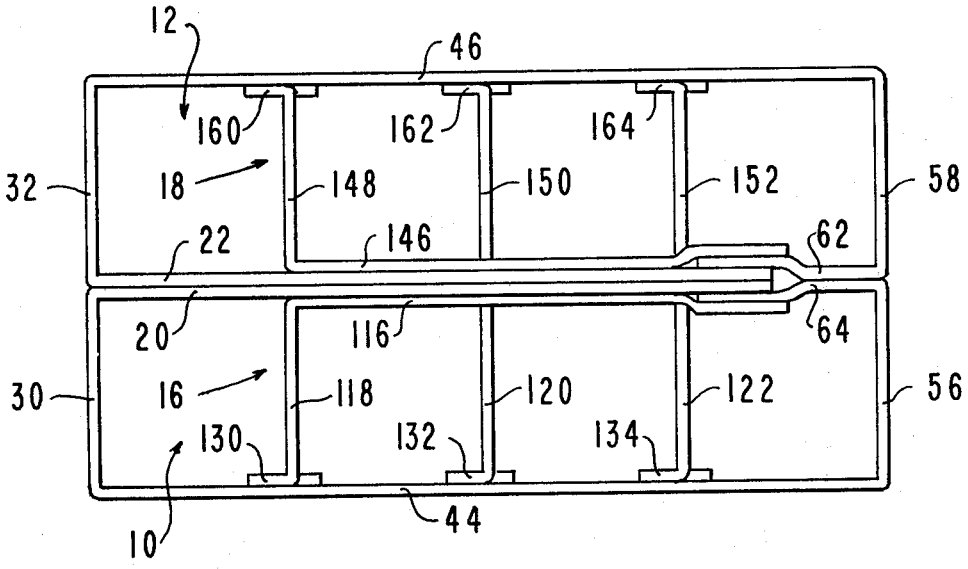
FIG. 5 is a horizontal cross section view taken at line 5—5 in FIG. 1.

As illustrated in FIG. 1, the invention is embodied in a foldable carrier having front and rear compartments indicated generally at 10 and 12, respectively, separated by a center keel or support indicated generally at 14. The front and rear compartments 10 and 12 are open at the top. The outer walls and bottom of the carrier as well as the center keel 14 are formed from a cut blank or piece illustrated in FIG. 2. Front and rear dividers indicated generally at 16 and 18 in FIG. 5 are installed in the respective front and rear compartments 10 and 12 to divide each of the compartments into four cells to thus form eight cells in the carrier for receiving articles such as bottles. The dividers 16 and 18 are formed from separate blanks illustrated in FIGS. 3 and 4, respectively.

Figures 2, 3, 4:
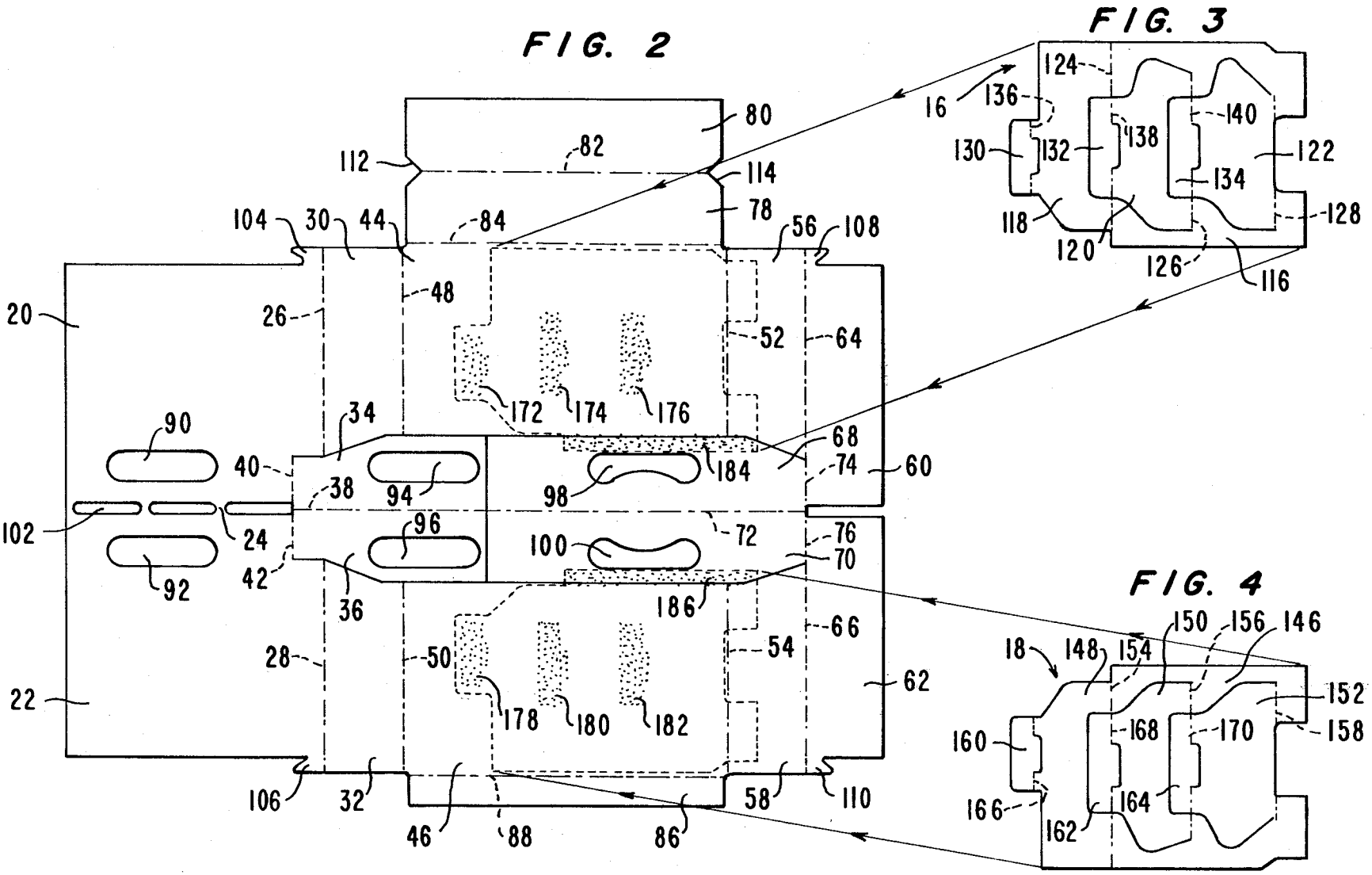
FIG. 2 is a plan view of a blank cut to form one piece of the carrier of FIG. 1.
FIG. 3 is a plan view of a blank cut to form a second piece of the carrier of FIG. 1.
FIG. 4 is a plan view of a blank cut to form a third piece of the carrier of FIG. 1.

The blank shown in FIG. 2 forms the center portion, the outer walls and bottom of the carrier. This blank includes front and rear large center panels 20 and 22 having inner edges (top edges when assembled into the completed carrier shown in FIG. 1) hinged together at a score line 24 and having right edges (left edges in FIG. 1) hinged at score lines 26 and 28 to left edges (inner edges in FIG. 1) of respective front and rear left side panels 30 and 32. Front and rear intermediate handle panels 34 and 36 are hinged together at score line 38 between the inner edges (upper edges in FIG. 1) of the panels 34 and 36 and are hinged at score lines 40 and 42 on left edges of the panels 34 and 36 to inner portions of the right edges (upper portions of the left edges in FIG. 1) of the panels 20 and 22. Front and rear wall panels 44 and 46 are hinged on their left edges at score lines 48 and 50 to right edges (outer edges in FIG. 1) of the respective front and rear left side panels 30 and 32 and are hinged on their right edges at score lines 52 and 54 to left edges (outer edges in FIG. 1) of respective front and rear right side panels 56 and 58. Front and rear small center panels 60 and 62 are hinged at respective score lines 64 and 66 on left edges (right edges in FIG. 1) of the panels 60 and 62 to right edges (inner edges in FIG. 1) of the front and rear right side panels 56 and 58. Front and rear outer handle panels 68 and 70 are hinged to each other at score line 72 at their inner edges (top edges in FIG. 1) and are hinged at score lines 74 and 76 on their right edges to respective inner portions of the left edges (upper portions of the right edges in FIG. 1) of the small center panels 60 and 62. Front and rear bottom panels 78 and 80 are hinged together at a score line 82 between their inner edges with the front bottom panel 78 being hinged at a score line 84 to the outer edge (bottom edge in FIG. 1) of the front panel 44. A glue flap 86 is hinged on the outer edge (bottom edge in FIG. 1) of the rear wall panel 46 at a score line 88 for overlapping and being glued to an outer portion of the rear bottom panel 80.

The large center panels 20 and 22 have a height substantially higher than the height of the front and rear wall panels 44 and 46 and side panels 30, 32, 56 and 58 to form upper handle portions which have respective finger openings 90 and 92 for mating with finger openings 94 and 96 in the intermediate handle panels 34 and 36 and finger openings 98 and 100 in the outer handle panels 68 and 70. Portions of the adjoining edges of the panels 20 and 22 are cut away to form elongated openings 102 along the score line 24 to substantially reduce the thickness of the upper edge of the handle formed by the upper portion of the panels 20 and 22, the intermediate handle panels 34 and 36 and the outer handle panels 68 and 70.

Additionally there are formed hooks 104 and 106 on the outer right (bottom left as viewed in FIG. 1) corners of the respective panels 20 and 22 for extending inward at the bottom of the carrier of FIG. 1. Similar hooks 108 and 110 are formed on the outer left (bottom right as viewed in FIG. 1) corners of the small center panels 60 and 62. Notches 112 and 114 are formed in the respective left and right edges of the bottom panels 78 and 80 at the center hinge line 82 therebetween for cooperating with the hooks 104, 106, 110 and 108 to permit the hooks to be inserted below the center of the joined bottom panels to aid in supporting the bottom panels.

The width of the front and rear large center panels 20 and 22 and the width of the front and rear small center panels 60 and 62 are selected so that when the carrier is assembled, right edge portions of the small center panels 60 and 62 (left edge portions as viewed in FIG. 1) overlap left edge portions of the panels 20 and 22 (right edge portions as viewed in FIG. 1). The sizes of the combined overlapping center panels 20, 22, 60 and 62 are selected to form a full two-ply divider and center support for the carrier between front and back compartments 10 and 12.

Referring to FIG. 3, the divider 16 has a support portion 116 with three transverse divider panels 118, 120, and 122 hinged on inner edges thereof to the support portion 116 at respective score lines 124, 126 and 128. Glue tabs 130, 132 and 134 are hinged at respective score lines 136, 138 and 140 on the outer edges of the transverse divider panels 118, 120 and 122.

The divider 18 is substantially an inverted image of the divider 16 and has a support portion 146 with transverse divider panels 148, 150 and 152 hingedly connected at inner edges thereof to the support portion at respective score lines 154, 156 and 158. Glue tabs 160, 162 and 164 are hinged to outer edges of the respective transverse divider panels 148, 150 and 152 at score lines 166, 168 and 170.

In assembly of the blanks of FIGS. 2, 3 and 4 to form the carrier of FIG. 1, the divider blanks 16 and 18 are first placed onto the blank of FIG. 2 as shown by the dashed lines. The tabs 130, 132 and 134 of the divider 16 are glued to the inside surface of the front wall 44 at respective glue areas 172, 174 and 176, and the tabs 160, 162 and 164 of the divider 18 are glued to the inside surface of the rear wall 46 at respective glue areas 178, 180 and 182. Also during the placing of the divider panels 16 and 18 on the blank of FIG. 2, upper edge portions of the support portions 116 and 146 of the dividers 16 and 18 are glued to inside surfaces of the outer or lower portions of the front and rear handle panels 68 and 70 at the glue areas 184 and 186, respectively. Then the intermediate handle panels 34 and 36 are folded over the score lines 40 and 42 and glued to the outer surfaces of the respective large center panels 20 and 22. The front and rear small center panels 60 and 62 are folded over the score lines 64 and 66 and glued to right edge portions of the support portions 116 and 146 of the divider panels 16 and 18. The panels 20 and 22 with the atached panels 34 and 36 as well as the panels 30 and 32 are folded about the score lines 48 and 50 with the outer surfaces of the panels 20 and 22 as well as the outer surfaces of the intermediate handle panels 34 and 36 being glued to the outer handle panels 68 and 70, the support portions 116 and 146 of the dividers 16 and 18 and the inside surfaces of the left edge portions of the front and rear small center panels 60 and 62. Then the rear bottom panel 80 is folded about the score line 82 over the inside surface of the front bottom panel 78 and the entire front portion of the carrier is folded about the score lines 24, 38 and 72, and the inside surfaces of the panels 20 and 22 and the panels 60 and 62 are glued together back-to-back. The rear edge portion of the bottom panel 80 is glued to the inside surface of the glue tab 86 to complete the gluing of the carrier. The carrier may then be opened in a conventional manner to the condition of FIG. 1 to receive bottles in the cells of the front and rear compartments 10 and 12.

Figure 6:
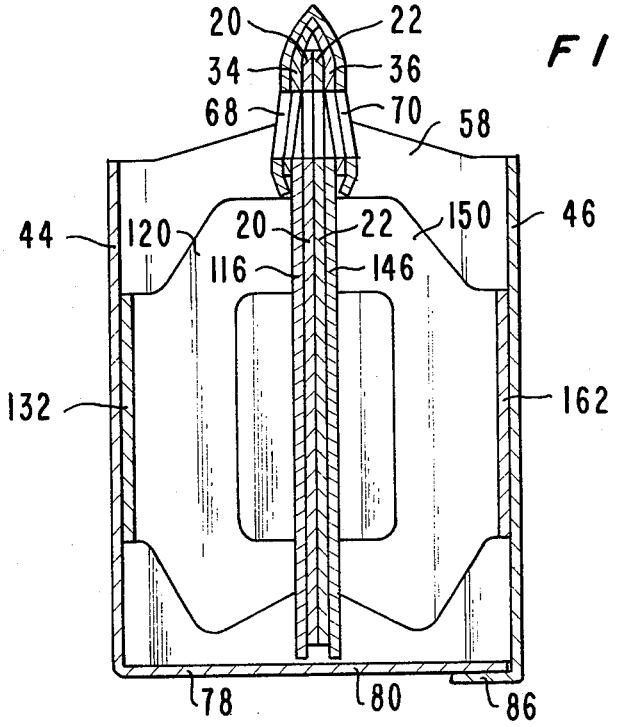
FIG. 6 is a vertical cross section view taken at line 6—6 in FIG. 1.

The present basket carrier has a substantially more solid construction resulting in a more durable carrier than similar type carriers of the prior art. The large two-center panels 20 and 22 in combination with the overlapping and attached small center panels 60 and 62 form a full two-ply center keel as shown in FIGS. 5 and 6, extending substantially the entire length and height of the carrier. This two-ply center keel, in addition to providing full separation of articles in the front compartment 10 from articles in the rear compartment 12, provides a strong support for the walls, the dividers, and the bottom of the carrier. Additionally the combination of the upper portions of the center panels 20 and 22 with the intermediate handle panels 34 and 36 and outer handle panels 68 and 70 provide a six-ply handle. This greatly reduces tearing of the handle of the carrier caused by use when the carrier contains a large number of articles such as eight bottles.

It is also noted that the front and rear dividers 16 and 18 are assembled in the flat condition as shown in FIGS. 3 and 4 and remain in this flat condition so long as the carrier is in a folded condition. Having the front and rear dividers 16 and 18 in an unfolded condition with the transverse partition panels 118, 120, 122, 148, 150 and 152 in the same planes as their respective support portions 116 and 146 eliminates folding steps for such dividers in the assembly operation and maintains maximum strength of the hinge joints in the divider by avoiding bending during assembly.

Since the present invention is subject to many modifications, variations and changes in detail, it is intended that all matter described above and shown in the accompanying drawings be interpreted as illustrative and not in a limiting sense.

What is claimed is:

1. A foldable basket carrier comprising front and rear full first center panels;

front and rear full second center panels having inner edge portions overlapping and secured to inner edge portions of the respective full first center panels to form front and rear full center members;

front and rear left side panels hingedly joined at inner edges thereof to outer edges of the respective front and rear first center panels;

front and rear right side panels hingedly joined at inner edges thereof to outer edges of the respective front and rear second center panels;

front and rear wall panels hingedly joined at the right and left edges thereof to outer edges of the respective front and rear panels of the right and left side panels;

front and rear bottom panel means hingedly joined together at inner edges thereof and hingedly joined at outer edges thereof to respective bottom edges of the front and rear wall panels;

said front and rear full center members being hingedly connected together at the top edges thereof, being secured back to back, having finger openings formed through upper portions thereof, and extending substantially the full length and height of the carrier to form a strong full two-ply center support; and separate front and rear partition means adhesively secured between the front surface of the center support and the front wall panel and between the rear surface of the center support and the rear wall panel, respectively, for forming a plurality of front and rear article receiving cells, a portion of the separate front and rear partition means being sandwiched between and being adhesively secured to the front and rear outer handle panels.

2. A foldable basket carrier as claimed in claim 1 wherein the front and rear partition means comprise, respectively, front and rear dividers each including a support portion secured to the center support, a plurality of transverse partition panels hinged on the support portion, and a plurality of tabs hinged on the outer edges of the respective transverse partition panels and being secured to the respective front and rear walls, wherein the transverse partition panels are in the same plane as the support portion when the carrier is in a collapsed condition.

3. A foldable basket carrier as claimed in claim 2 wherein the plurality of transverse partition panels in each of the front and rear dividers comprise three transverse partition panels to form an eight-cell basket carrier.

4. A foldable basket carrier as claimed in claim 1 wherein said finger openings are formed in upper portions of the front and rear first center panels; and the carrier includes front and rear intermediate handle panels with respective finger openings therein and secured on the outside surfaces of the upper portions of the front and rear first center panels, and front and rear outer handle panels with respective finger openings formed therein and secured to outer surfaces of the intermediate front and rear handle panels to form a six-ply handle for the carrier.

5. A foldable basket carrier as claimed in claim 4 wherein the intermediate handle panels are hinged together at their top edges, the intermediate handle panels are hinged at one side edges thereof to upper portions of the outer edges of the respective front and rear first center panels, the front and rear outer handle panels are hinged together at their top edges, and the outer handle panels are hinged at one side edges thereof to upper portions of outer edges of the respective front and rear second center panels.

6. A blank for forming a foldable basket carrier comprising:

(a) front and rear first center panels hingedly connected together at inner edges thereof, the first center panels having finger openings through adjacent portions thereof;

(b) front and rear left side panels hingedly connected to their respective front and rear first center panels;

(c) front and rear wall panels hingedly connected to their respective front and rear left side panels;

(d) front and rear right side panels hingedly connected to their respective front and rear wall panels;

(e) front and rear second center panels hingedly connected to their respective front and rear right side panels;

(f) front and rear bottom panels hingedly connected together and to one of the wall panels;

(g) a glue flap hingedly connected to the other of the wall panels;

(h) front and rear intermediate handle panels hingedly connected together and to the front and rear first center panels and being positioned partly between the front and rear center panels, partly between the front and rear left side panel and partly between the front and rear wall panel, the intermediate handle panels having finger openings through adjacent portions thereof;

(i) front and rear outer handle panels hingedly connected together and to the intersection of the front and rear right side panels and the front and rear second center panels and being positioned partly between the front and rear right side panels and partly between the front and rear wall panels, the outer handle panels having finger openings through adjacent portions thereof;

(j) a separate flat front compartment divider adhesively secured to the front wall panel and also to the front outer handle panel; and (k) a separate flat rear compartment divider adhesively secured to the rear wall panel and also to the rear outer handle panel.

7. The blank as defined in claim 6 further comprising the front and rear compartment dividers having formed therein a plurality of transverse partitions.

* * * * *